US005489343A

United States Patent [19]

Uchida et al.

[11] Patent Number: 5,489,343

[45] Date of Patent: Feb. 6, 1996

[54] METHOD FOR PRODUCING R-FE-B-BASED, SINTERED MAGNET

[75] Inventors: Kimio Uchida, Saitama; Masahiro Takahashi; Masamichi Ozaki, both of Kumagaya; Akira Kikuchi, Saitama, all of Japan

[73] Assignee: Hitachi Metals, Ltd., Tokyo, Japan

[21] Appl. No.: 187,007

[22] Filed: Jan. 27, 1994

[30] Foreign Application Priority Data

| | | | |
|---|---|---|---|
| Jan. 29, 1993 | [JP] | Japan | 5-013088 |
| Jan. 29, 1993 | [JP] | Japan | 5-013089 |
| Mar. 19, 1993 | [JP] | Japan | 5-059820 |
| Jul. 15, 1993 | [JP] | Japan | 5-175088 |
| Aug. 12, 1993 | [JP] | Japan | 5-200543 |

[51] Int. Cl.[6] ..... H01F 1/057

[52] U.S. Cl. ..... 148/103; 148/101; 148/104; 419/12; 419/30

[58] Field of Search ..... 148/101, 102, 148/103, 104, 105; 419/12, 30

[56] References Cited

U.S. PATENT DOCUMENTS

| | | | |
|---|---|---|---|
| 3,785,881 | 1/1974 | Naastepad et al. | 148/103 |
| 3,901,742 | 8/1975 | Facacaros | 148/105 |
| 4,911,882 | 3/1990 | Greenwald | 419/12 |

FOREIGN PATENT DOCUMENTS

| | | | |
|---|---|---|---|
| 61-114505 | 6/1986 | Japan . | |
| 62-245604 | 10/1987 | Japan | 148/104 |

OTHER PUBLICATIONS

Noller, "Chemistry of Organic Compounds", 1966 pp. 61, 62, 67 and 464.

*Primary Examiner*—John Sheehan

*Attorney, Agent, or Firm*—Sughrue, Mion, Zinn, Macpeak & Seas

[57] ABSTRACT

An R-Fe-B-based, sintered magnet, wherein R is one or more of rare earth elements including Y, is produced by the method including the steps of mixing fine R-Fe-B-based magnet powder with a mineral oil and/or a synthetic oil having a fractional distillation temperature range of 150°–400° C. and a kinetic viscosity of 10 cSt or less to prepare a mixture; charging the mixture under pressure into a die cavity equipped with a filter, to which an orientated magnetic field is applied, while removing a mineral oil and/or a synthetic oil from the mixture; compressing the mixture in the die cavity to carry out a wet molding while orientating the powder to prepare a green body; heating the green body to a temperature up to 500° C. at a speed of 10° C./min or less under pressure of $10^{-1}$ Torr or less for 30 minutes or more to remove a mineral oil and/or a synthetic oil from the green body; and then sintering the green body.

20 Claims, 4 Drawing Sheets

METHOD FOR PRODUCING R-FE-B-BASED, SINTERED MAGNET

BACKGROUND OF THE INVENTION

The present invention relates to a method for producing an R-Fe-B-based, sintered magnet wherein R is one or more of rare earth elements including Y.

An R-Fe-B-based, sintered magnet may typically be produced by melting and casting alloy metals for the magnet to form an alloy ingot, pulverizing the ingot to alloy powder, molding and sintering the alloy powder, heat-treating the sintered body and then working it. For the purpose of finely pulverizing coarse alloy powder, a jet milling method comprising impinging coarse alloy powder each other in a high-pressure inert gas atmosphere may be utilized to produce dry, fine powder, and a wet powder method such as a ball milling method, a vibration milling method, etc., in which a magnet alloy is pulverized in an organic solvent, may also be utilized to form a mixture of fine alloy powder and an organic solvent which is then dried to provide dry alloy powder. The formation of a green body from the dry alloy powder may be conducted by introducing a measured amount of the dried alloy powder into a die cavity, and then compressing the alloy powder in the die cavity while applying an orientated magnetic field. Alternatively, the dry alloy powder may be introduced into a die cavity to which a magnetic field is applied in advance and then compressed.

Since pulverized R-Fe-B-based magnet is chemically extremely active, it is highly likely that the R-Fe-B-based magnet powder is rapidly oxidized in the air, resulting in the deterioration of magnetic properties. Japanese Patent Laid-Open No. 61-114505 and U.S. Pat. No. 4,911,882 disclose a method for preventing the oxidation of R-Fe-B-based magnet powder, in which starting material powder is mixed with an organic solvent, the resulting mixture is introduced into a die cavity in the same manner as for the dry alloy powder and compressed in a magnetic field, and the resulting green body is dried, sintered and heat-treated. By this method, the deterioration of magnetic properties by oxidation can be prevented because the alloy powder is compressed into a green body in an organic solvent. However, regardless of whether the dry alloy powder or a mixture of alloy powder and an organic solvent is used, the above method fails to provide a sintered magnet with excellent magnetic properties which are potentially owned by the R-Fe-B-based magnet powder, meaning that the resultant R-Fe-B-based, sintered magnet shows unsatisfactory magnetic properties.

As a result of analysis as to why the above conventional method fails to draw satisfactory magnetic properties from the R-Fe-B-based magnet powder, the inventors have found the following facts:

(a) Pulverized R-Fe-B-based magnet particles show a strong interaction between themselves because they have several times as large a coercive force as that of a ferrite magnet, so that fine powder is likely to form bridges between them. Accordingly, even in a magnetic field the R-Fe-B-based magnet powder is not always well orientated locally in a die cavity.

(b) The fine R-Fe-B-based magnet powder orientated to a certain level in a die cavity by a magnetic field applied thereto is likely to be disturbed with respect to its orientation by a compression force in the process of forming a green body. The extent to which the orientation of the fine R-Fe-B-based magnet powder is disturbed is large when the direction of a magnetic field applied is in parallel with the direction of compression, namely in the case of a vertical magnetic field. However, the disturbance of the orientation of the fine R-Fe-B-based magnet powder may take place also when the direction of a magnetic field applied is in perpendicular to the direction of compression, namely in the case of a transverse magnetic field.

Because of the above two phenomena, the fine R-Fe-B-based magnet powder is not well orientated in a die cavity by the above conventional method, resulting in a sintered magnet with poor residual magnetic flux density and maximum energy product.

OBJECT AND SUMMARY OF THE INVENTION

Accordingly, an object of the present invention is to provide a method for producing an R-Fe-B-based, sintered magnet with drastically improved magnetic properties.

It has been found from the above analysis that in order to achieve good orientation of fine R-Fe-B-based magnet powder, the formation of bridges of fine R-Fe-B-based magnet powder particles and the disturbance of their orientation during compression should be avoided. As a result, the inventors have found that by charging a mixture of a fine R-Fe-B-based magnet powder and a mineral oil and/or a synthetic oil into a die cavity under pressure higher than a certain level, and by subjecting the mixture to a wet molding, the above objects can be achieved simultaneously, thereby providing an R-Fe-B-based, sintered magnet with drastically improved orientation.

Thus, the first method for producing an R-Fe-B-based, sintered magnet according to the present invention comprises the steps of mixing fine R-Fe-B-based magnet powder with a mineral oil and/or a synthetic oil to prepare a mixture; charging the mixture into a die cavity under pressure; subjecting the mixture to a wet molding to prepare a green body; and then sintering the green body.

The second method for producing an R-Fe-B-based, sintered magnet according to the present invention comprises the steps of mixing fine R-Fe-B-based magnet powder with a mineral oil and/or a synthetic oil to prepare a mixture; charging the mixture under pressure into a die cavity to which an orientated magnetic field is applied; subjecting the mixture to a wet molding while orientating the powder to prepare a green body; and then sintering the green body.

The third method for producing an R-Fe-B-based, sintered magnet according to the present invention comprises the steps of finely pulverizing an R-Fe-B-based magnet material in an inert gas atmosphere to prepare fine R-Fe-B-based magnet powder in a dry state; introducing the dry fine R-Fe-B-based magnet powder into a mineral oil and/or a synthetic oil in an inert gas atmosphere to prepare a mixture; charging the mixture under pressure into a die cavity to which an orientated magnetic field is applied; subjecting the mixture to a wet molding while orientating the powder to prepare a green body; and then sintering the green body.

DETAILED DESCRIPTION OF THE INVENTION

Figure 1:
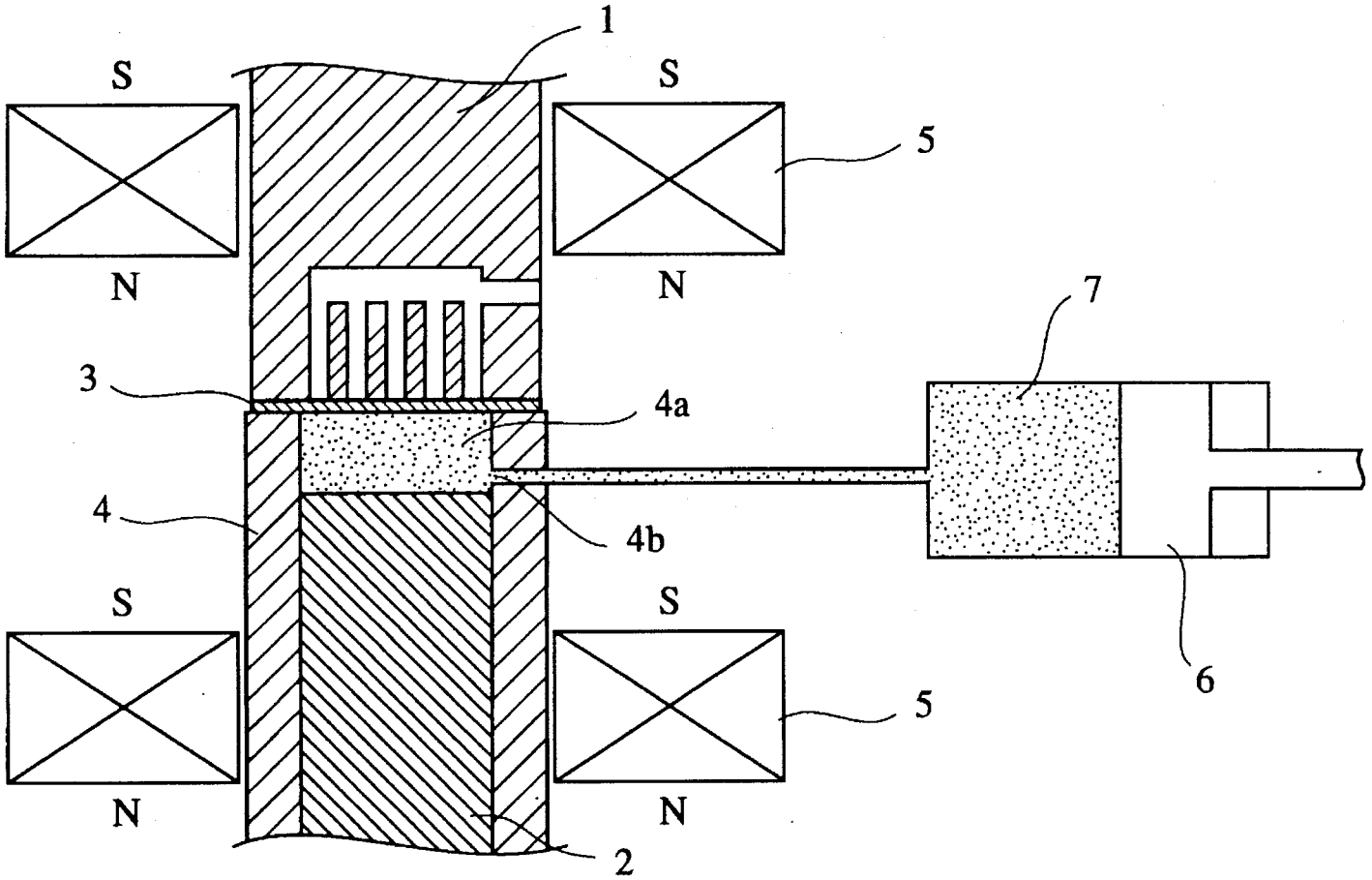
FIG. 1 is a partial vertical cross-sectional view showing a molding apparatus for use in the method of the present invention.

The present invention will be described in detail below.

In one preferred embodiment, the method for producing an R-Fe-B-based, sintered magnet comprises the steps of mixing fine R-Fe-B-based magnet powder with a mineral oil and/or a synthetic oil having a fractional distillation temperature range of 150°–400° C. and a kinetic viscosity of 10 cSt or less to prepare a mixture; charging the mixture under pressure into a die cavity equipped with a filter while removing the mineral oil and/or the synthetic oil from the mixture; compressing the mixture in the die cavity to carry out a wet molding for preparing a green body; heating the green body to a temperature up to 500° C. at a temperature-elevating speed of 10° C./min or less under pressure of $10^{-1}$ Torr or less for 30 minutes or more to remove the mineral oil and/or the synthetic oil from the green body; and then sintering the green body.

In another preferred embodiment, the method for producing an R-Fe-B-based, sintered magnet comprises the steps of mixing fine R-Fe-B-based magnet powder with a mineral oil and/or a synthetic oil having a fractional distillation temperature range of 150°–400° C. and a kinetic viscosity of 10 cSt or less to prepare a mixture; charging the mixture under pressure into a die cavity equipped with a filter, to which an orientated magnetic field is applied, while removing the mineral oil and/or the synthetic oil from the mixture; compressing the mixture in the die cavity to carry out a wet molding while orientating the powder to prepare a green body; heating the green body to a temperature up to 500° C. at a temperature-elevating speed of 10° C./min or less under pressure of $10^{-1}$ Torr or less for 30 minutes or more to remove the mineral oil and/or the synthetic oil from the green body; and then sintering the green body.

In a further preferred embodiment, the method for producing an R-Fe-B-based, sintered magnet comprises the steps of finely pulverizing an R-Fe-B-based magnet material in an inert gas atmosphere to prepare fine R-Fe-B-based magnet powder in a dry state; introducing the fine R-Fe-B-based magnet powder in an inert gas atmosphere into a mineral oil and/or a synthetic oil having a fractional distillation temperature range of 150°–400° C. and a kinetic viscosity of 10 cSt or less; mixing the fine R-Fe-B-based magnet powder with the mineral oil and/or the synthetic oil to prepare a mixture; charging the mixture under pressure into a die cavity equipped with a filter, to which an orientated magnetic field is applied, while removing the mineral oil and/or the synthetic oil from the mixture; compressing the mixture in the die cavity to carry out a wet molding while orientating the powder to prepare a green body; heating the green body to a temperature up to 500° C. at a temperature-elevating speed of 10° C./min or less under pressure of $10^{-1}$ Torr or less for 30 minutes or more to remove the mineral oil and/or the synthetic oil from the green body; and then sintering the green body.

[A] R-Fe-B-based Magnet Alloy

In the R-Fe-B sintered magnet alloy used in the method of the present invention, R is one or more of rare earth elements including Y, for instance, Nd, Dy, Pr, etc. The composition of the R-Fe-B sintered magnet is preferably such that R is 20–40% by weight, Fe is 50–75% by weight and B is 0.2–8% by weight. When R (one or more rare earth metals including Y) is less than 20 weight %, sufficient iHc cannot be obtained, and when it exceeds 40 weight %, the Br of the R-Fe-B sintered magnet decreases. When B is less than 0.2 weight %, an $R_2Fe_{14}B$ phase, a main phase, of the sintered magnet is not fully formed, resulting in low Br and iHc. On the other hand, when it exceeds 8 weight %, a phase undesirable for magnetic properties appears, resulting in low Br. The amount of Fe, which may be partially substituted with Co and/or Ni, is preferably 50–75% by weight.

One or more of Ga, Al, Ti, V, Cr, Mn, Zr, Hf, Nb, Ta, Mo, Ge, Sb, Sn, Bi, etc. may be added to the R-Fe-B magnet alloy depending upon its application. These elements are preferably 5% by weight or less.

[B] Mineral Oil and/or Synthetic Oil

The mineral oil and the synthetic oil used in the method of the present invention are hydrophobic organic solvents which are not reactive to rare earth elements in the R-Fe-B-based magnet powder. They do not contain fluorine groups, chlorine groups, etc., which causes the deterioration of magnetic properties. Accordingly, the mineral oil and the synthetic oil do not produce unsatisfactory compounds such as carbides of rare earth elements when mixed with the fine R-Fe-B-based magnet powder. The preferred examples of the mineral oil and the synthetic oil include naphthenic hydrocarbons, aromatic hydrocarbons, linear paraffinic hydrocarbons, branched paraffinic hydrocarbons, olefinic hydrocarbons. These hydrophobic hydrocarbons may be used alone or in combination.

To prevent the fine R-Fe-B-based magnet powder particles from forming bridges between themselves due to their interaction, it is effective to modify surfaces of the fine R-Fe-B-based magnet powder particles and reduce friction between the fine R-Fe-B-based magnet powder particles by mixing the fine R-Fe-B-based magnet powder with a mineral oil and/or a synthetic oil.

With respect to the mineral oil, when the kinetic viscosity of the mineral oil at room temperature exceeds 10 cSt, the fine R-Fe-B-based magnet powder particles are stick to each other with the mineral oil, thereby increasing the bridging of the fine R-Fe-B-based magnet powder particles. Accordingly, the kinetic viscosity of the mineral oil at room temperature is preferably 10 cSt or less, more preferably 1.0–5.0 cSt. Also, if the fractional distillation temperature range of the mineral oil exceeds 400° C., it would be difficult to remove the mineral oil from the fine R-Fe-B-based magnet powder at the time of sintering, whereby a large amount of carbon remains in the resulting sintered body, resulting in a decrease in magnetic properties, particularly coercivity. Accordingly, the fractional distillation temperature range of the mineral oil is preferably 400° C. or lower. The preferred lower limit of the fractional distillation temperature range is 100° C.. The more preferred fractional distillation temperature range is 150°–400° C.. Incidentally, the term "fractional distillation temperature range" used herein means a temperature range in which all components from the most volatile component to the lowest-boiling point component in the mineral oil substantially evaporate. This term is used for the same meaning with respect to the synthetic oil.

With respect to the synthetic oil, the kinetic viscosity of the synthetic oil at room temperature is preferably 10 cSt or less, more preferably 1.0–5.0 cSt, and the fractional distillation temperature range of the synthetic oil is preferably 400° C. or lower, for the same reasons as in the mineral oil. The preferred lower limit of the fractional distillation temperature range is 100° C. The more preferred fractional distillation temperature range is 150°–400° C.

When an organic solvent such as toluene and hexane is used, the dragging of a die is likely to take place during die molding. Accordingly, the mineral oil or the synthetic oil is preferably used to prevent the dragging of dies. Also, the R-Fe-B-based magnet powder in a mineral oil or a synthetic oil is less likely to be deteriorated with the time passing.

As described above, to prevent the bridging of the fine R-Fe-B-based magnet powder particles by reduction of friction, it is effective to mix the fine R-Fe-B-based magnet powder with a mineral oil or a synthetic oil having particular properties relative to the fine R-Fe-B-based magnet powder. A mixing ratio of the R-Fe-B-based magnet powder to the mineral oil or the synthetic oil is not particularly restricted. However, to reduce the variation of size and weight of a green body obtained by a wet molding, the weight proportion of the fine R-Fe-B-based magnet powder in the mixture is preferably 50–80%, more preferably 60–70%.

[C] Production of R-Fe-B-based, Sintered Magnet

The mixing of the fine R-Fe-B-based magnet powder with the solvent may be conducted by any method. For instance, the fine R-Fe-B-based magnet powder and the solvent may be separately weighed and mixed with each other. Alternatively, the fine R-Fe-B-based magnet powder may be pulverized in a dry state by a pulverizing apparatus such as a jet mill, etc. and the pulverized powder may be introduced into a solvent disposed at an exit of the pulverizing apparatus to produce a mixture. Further, the coarse R-Fe-B-based magnet powder may be wet-pulverized in the solvent by a vibration mill, a ball mill, an attritor, etc. to produce a mixture. Incidentally, the finely pulverized R-Fe-B-based magnet powder preferably has an average diameter of 1–10 μm, more preferably 3–6 μm.

For the reasons mentioned above, in order to achieve a good orientation of the fine R-Fe-B-based magnet powder, it is not sufficient to prevent the bridging of the R-Fe-B-based magnet powder by using a mixture of the fine R-Fe-B-based magnet powder with the solvent. Specifically, if a mixture of the fine R-Fe-B-based magnet powder with the organic solvent is formed into a green body by the method disclosed in Japanese Patent Laid-Open No. 61-114505 and U.S. Pat. No. 4,911,882, sufficiently high orientation of the R-Fe-B-based magnet powder cannot be achieved.

As a result of research on how to prevent the disorientation of the fine R-Fe-B-based magnet powder during the formation of a green body, it has been found that the disorientation of the fine R-Fe-B-based magnet powder can be avoided by increasing the filling density of the R-Fe-B-based magnet powder in the die cavity. The term "filling density" used herein means a density of the fine R-Fe-B-based magnet powder introduced into a die cavity 4a under pressure by a pressuring means 6, part of the mineral oil or the synthetic oil being squeezed out and discharged through a filter 3 mounted to an upper punch means 1. One reason therefor is that in the fine R-Fe-B-based magnet powder disposed in a die cavity with a higher orientation than a certain level, as the amount of the fine powder per a unit volume increases, namely as the filling density of the fine powder in a die cavity increases, the fine powder shows larger complementary effects which serve to decrease the deviation of the fine powder from the desired orientation by an external pressure during the formation of a green body. To satisfy the above object, the filling density of the fine R-Fe-B-based magnet powder in a die cavity (net weight (g) of the fine powder charged into a die cavity / volume ($cm^3$) of a cavity) is 1.8 $g/cm^3$ or more, preferably 2.0 $g/cm^3$ or more, particularly 2.2–3.6 $g/cm^3$. This can be achieved by charging a mixture of the fine R-Fe-B-based magnet powder with the mineral oil or the synthetic oil into a die cavity under pressure.

FIG. 1 shows one example of a method for charging a starting material mixture into a die cavity 4a under pressure in the case of molding in a magnetic field. In the apparatus shown in FIG. 1, an upper punch means 1 is stationary, while a lower punch means 2 is movable vertically back and forth in a die 4. A filter 3 is mounted to the upper punch means 1 so that an excess solvent squeezed out of the mixture 7 introduced into a die cavity 4a can be discharged. Since an inlet opening 4b communicating with a pressuring means 6 for supplying the mixture 7 into the cavity 4a under pressure is disposed near an upper surface of the lower punch means 2, the inlet opening 4b is closed when the lower punch means 2 has moved upward by a small distance.

The starting material mixture 7 is charged into a die cavity 4a under pressure by a pressurizing means 6, and a most part of the solvent is squeezed out from the mixture 7 by pressure and discharged from the die 4 through a filter 3 disposed in the die cavity 4a. Accordingly, the filling density of the R-Fe-B-based magnet powder in the die cavity 4a is very high at the time of forming a green body. The driving of the pressurizing means 6 for compressing the starting material mixture 7 may be effected by various methods such as a hydraulic driving method, a gas driving method, etc.

When a starting material mixture 7 containing fine R-Fe-B-based magnet powder having as large a specific gravity as 7 $g/cm^3$ or more is charged into a die cavity 4a, it is necessary that the charging pressure of the mixture 7 in the course from the cavity-pressurizing means 6 to the inlet 4b of the cavity 4a is 1 $kgf/cm^2$ or more. If the charging pressure is less than 1 $kgf/cm^2$, the mixture 7 is not stably introduced into the die cavity 4a, resulting in the large variation of size and weight of the green body, and failing to achieve a high filling density which in turn leads to a decrease in orientation and thus a decrease in magnetic properties. The preferred charging pressure of the mixture 7 is 2–40 $kgf/cm^2$.

During supplying and compressing the mixture 7, an orientated magnetic field is generated from a pair of coils 5, 5 and applied to the die cavity 4a vertically. The timing of applying the orientated magnetic field to the mixture 7 to orientate the fine R-Fe-B-based magnet powder to impart anisotropy to the magnet may be determined depending on the type of the starting materials, the method of forming a green body, etc. For example, the following methods can be utilized:

(a) Applying an orientated magnetic field to a die cavity 4a since before charging the mixture 7 into a die cavity 4a under pressure.

(b) Applying an orientated magnetic field to a die cavity 4a while charging the mixture 7 into a die cavity 4a under pressure.

Since the fine R-Fe-B-based magnet powder has a coercive force several times to several tens of times larger than those of ferrite magnet and Alnico magnet, the intensity of the orientated magnetic field applied to the mixture 7 in the die cavity 4*a* should be as high as 2 kOe or more, regardless of which timing of applying the magnetic field is selected among those described above. When the intensity of the orientated magnetic field is less than 2 kOe, sufficient orientation cannot be achieved even in the method of the present invention, failing to provide a sintered magnet with satisfactory residual magnetic flux density and maximum energy product. Incidentally, the control of the intensity of the orientated magnetic field is also effective to achieve good orientation. Specifically, by changing the intensity of the orientated magnetic field applied before or during the charging of the starting material mixture 7 into the die cavity 4*a*, the sintered body can effectively be provided with good magnetic properties.

In the charging of the starting material mixture 7 into the die cavity 4*a* under pressure and in the wet molding thereof, it is effective to use a filter 3 to remove the solvent from the mixture 7 and to prevent the fine powder from flowing out of the die cavity 4*a*. The filter 3 may be made of a cloth, a paper, a metal, etc. though these examples are not restrictive. The form of the filter 3 may be selected properly depending on a magnetic circuit formed through the die cavity 4*a*, and their examples are a sheet, a block, etc. The mounting of the filter 3 to the die 4 may be effected by a proper means such as mechanical fastening, welding, shrinkage fit, adhesion, etc., depending on the material of the filter 3 and the shape and structure of the die 4.

Figure 2:
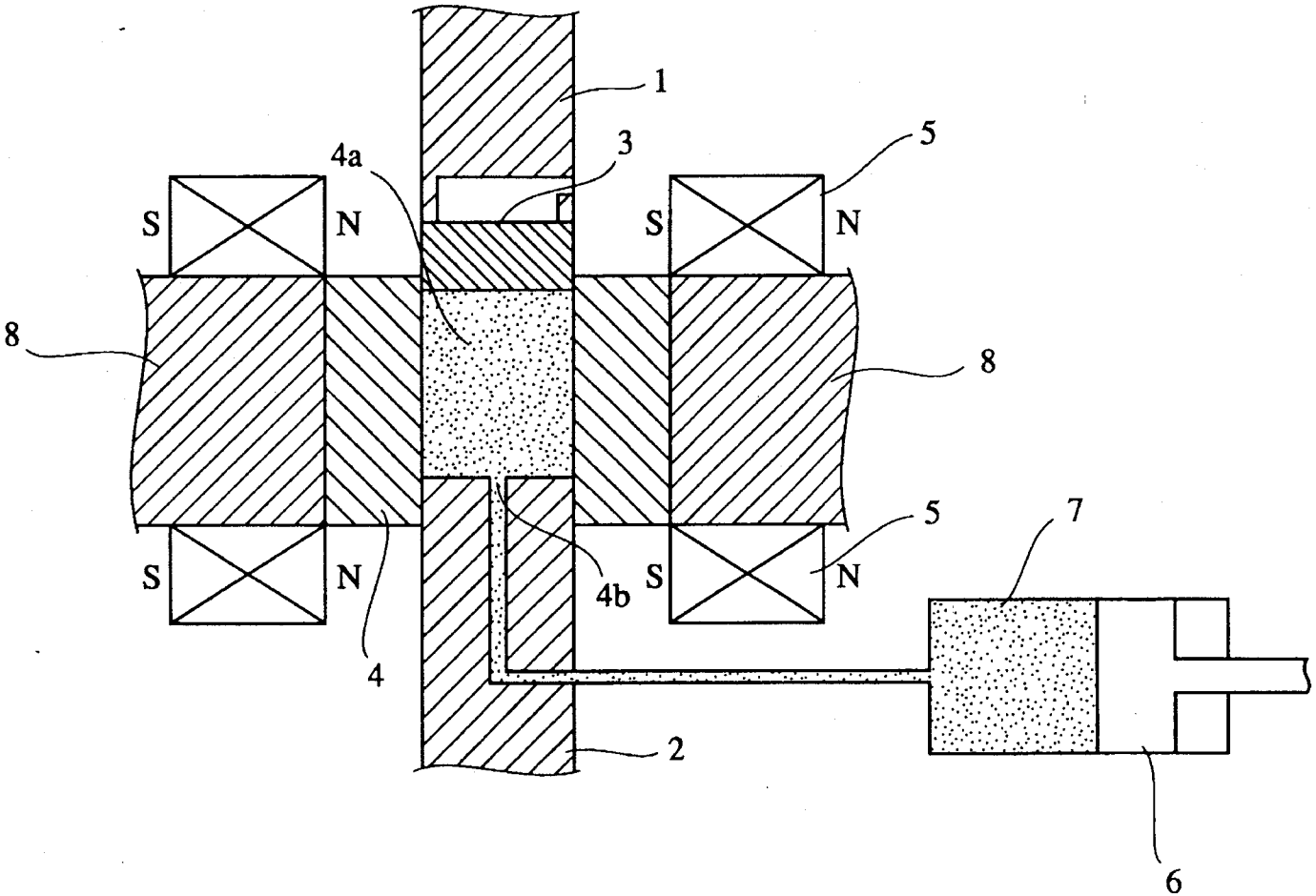
FIG. 2 is a partial vertical cross-sectional view showing another molding apparatus for use in the method of the present invention.

When part of the die 4 is formed by a porous metal material as a filter 3, the wear of the filter 3 is decreased, thereby advantageously eliminating the frequent exchange of the filter 3. FIG. 2 shows one example of a porous metal material welded as a filter 3 to an upper punch means 1 through which a magnetic circuit for forming a transverse magnetic field passes. In this apparatus, there is a yoke 8 between a pair of magnetization coils 5, 5 to generate a transverse magnetic field. With respect to the other parts, it is to be noted that the same reference numerals as in FIG. 1 are assigned to the same parts as in FIG. 1.

In the apparatus shown in FIG. 2, an upper punch means 1 may be movable vertically back and forth, while a lower punch means 2 is stationary in a die 4. A filter 3 is mounted to the upper punch means 1 so that an excess solvent squeezed out of the mixture 7 introduced into a die cavity 4*a* can be discharged.

Depending on the structure of the die 4, an entire portion of an upper punch means 1 or both upper and lower punch means 1, 2 may be made of a porous metal material. The pore size of the porous metal material may be selected depending on the composition and particle size of the fine R-Fe-B-based magnet powder used. Considering the capability of removing the solvent, the average pore size of the porous metal material is preferably 20 μm or less, more preferably 10 μm or less, and particularly 1–5 μm.

Figure 3:
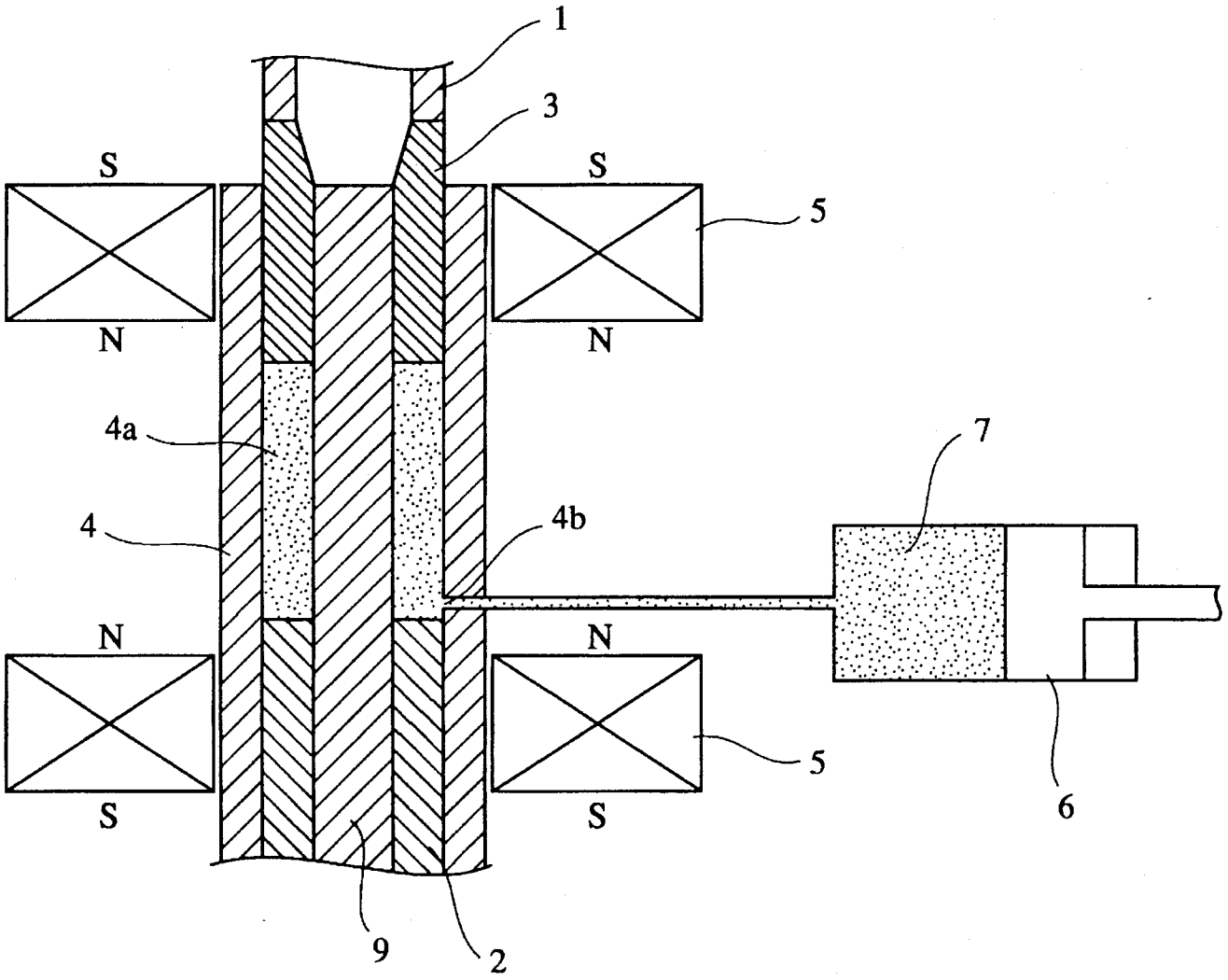
FIG. 3 is a partial vertical cross-sectional view showing a molding apparatus for producing a radially anisotropic ring magnet by the method of the present invention.

Other molding methods than the molding in a vertical magnetic field shown in FIG. 1 and the molding in a transverse magnetic field shown in FIG. 2 may also be used effectively in the method of the present invention. Examples of such molding method are shown in FIG. 3 in the case of forming a radially anisotropic ring magnet, and in FIGS. 4 and 5 in the case of forming a multi-polar anisotropic ring magnet. It is to be noted that the same reference numerals as in FIG. 2 are assigned to the same parts as in FIG. 2.

In the apparatus of FIG. 3, there is a core 9 in a die 4 to define a ring-shaped cavity 4*a*. An upper punch means 1 equipped with a filter 3 is stationary, while a lower punch means 2 is movable vertically back and forth in a die 4. Since an inlet opening 4*b* is disposed near an upper surface of the lower punch means 2, the inlet opening 4*b* is closed when the lower punch means 2 has moved upward by a small distance.

Figure 4:
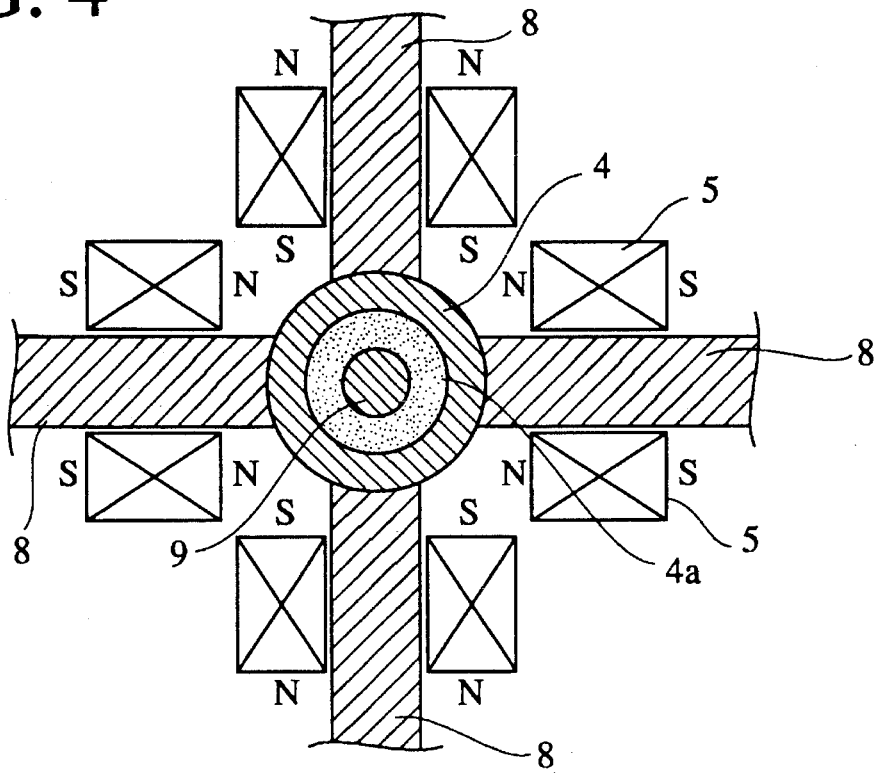
FIG. 4 is a plan view showing a molding apparatus for producing a multi-polar anisotropic ring magnet by the method of the present invention.
Figure 5:
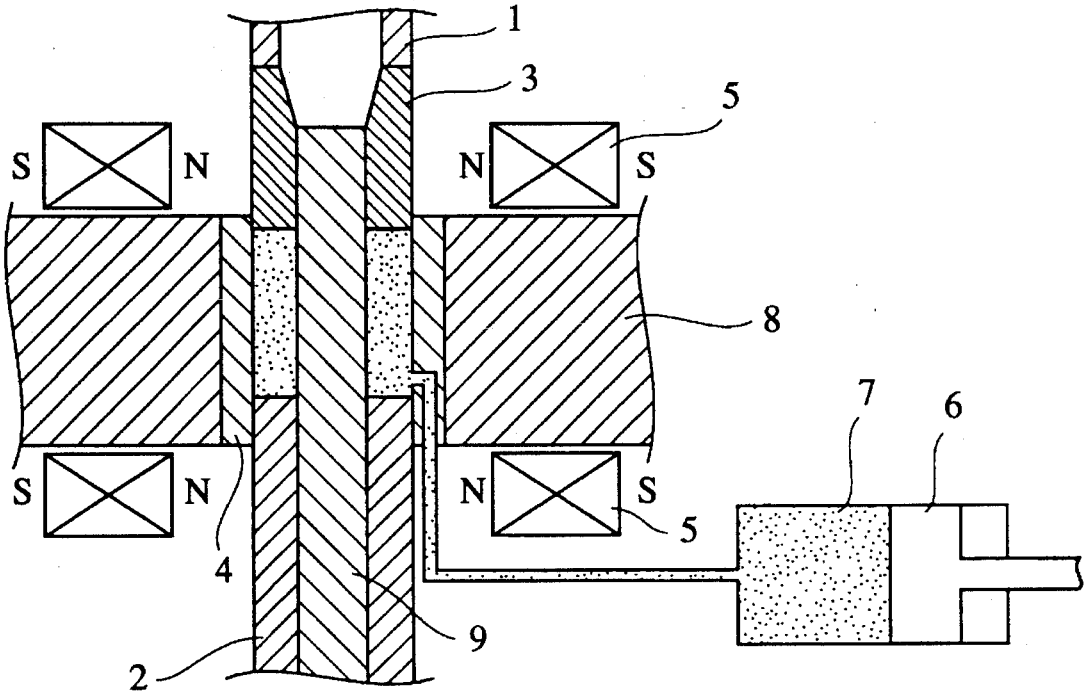
FIG. 5 is a partial vertical cross-sectional view showing the molding apparatus of FIG. 4.

In the apparatus of FIGS. 4 and 5, there is a core 9 in a die 4 to define a ring-shaped cavity 4*a*, and a plurality of coils 5 are disposed around a die 4 to provide a plurality of magnetic poles to a surface of the resulting ring magnet. Disposed between upper and lower magnetization coils 5, 5 is a yoke 8 which surrounds a die 4. An upper punch means 1 equipped with a filter 3 is stationary, while a lower punch means 2 is movable vertically back and forth in a die 4. An inlet opening 4*b* is disposed near an upper surface of the lower punch means 2.

The inventors have tried to charge the fine R-Fe-B-based magnet powder in a dry state into a die cavity 4*a* under pressure without mixing the powder with a mineral oil or a synthetic oil. Specifically, with a high-pressure $N_2$ gas or a high-pressure Ar gas, the chargeability of the powder under gas pressure was evaluated. However, the amount of the fine R-Fe-B-based magnet powder charged in each shot changes largely, failing to control the weight and size of the green body, presumably because the solvent is not used. Also, the fine R-Fe-B-based magnet powder frequently generated heat and was ignited when charged into the die cavity 4*a*, failing to provide stable magnetic properties, presumably because a trace amount of oxygen contained in the $N_2$ gas or the Ar gas is reacted with the fine R-Fe-B-based magnet powder being charged into the die cavity 4*a*, or presumably because of friction of the fine powder with a hose through which the fine powder is forced into the die cavity 4*a*.

The starting material mixture 7 charged into the die cavity 4*a* and orientated by applying a magnetic field as described above is wet-molded by the method illustrated in FIGS. 1–5, and then sintered. Depending on the production conditions and system, the green body may have to be stored until it is sintered. In such a case, the green body may be oxidized by oxygen in the air when left in the air. To prevent the oxidation of the green body, the green body should be stored in a non-oxidizing atmosphere or a reducing atmosphere. It is desirable that it is stored in a state wet with a mineral oil, a synthetic oil or a hydrophobic organic solvent, and that the mineral oil, the synthetic oil or the hydrophobic organic solvent is removed at the step of elevating a temperature in the process of sintering. Since the green body is kept wet with the mineral oil, the synthetic oil or the hydrophobic organic solvent, it is substantially not oxidized, thereby suppressing an increase in the content of oxygen in the resulting sintered body.

In the present invention, a liquid in which the fine powder is stored is limited to a mineral oil, a synthetic oil or a hydrophobic solvent. This is because a hydrophilic organic solvent such as ethanol, acetone, etc. is so likely to contain water that when the coarse or fine R-Fe-B-based magnet powder is immersed in the solvent, water in the solvent is reacted with a rare earth element in the R-Fe-B-based magnet powder to form a rare earth element oxide, which leads to the consumption of a rare earth element contributing to a liquid sintering and magnetic properties. To keep the wet-molded green body in a wet state with a mineral oil, a synthetic oil or a hydrophobic organic solvent, it may be immersed in such solvent, or held in a mist of such solvent.

The resulting green body of the fine R-Fe-B-based magnet powder has an apparent density of 3.5 g/cm$^3$ or more, preferably about 4.0–5.0 g/cm$^3$.

Since the solvent such as a mineral oil or a synthetic oil remains in the green body before sintering, the solvent in the green body is reacted with a rare earth element in the R-Fe-B-based magnet powder formed into the green body when heated rapidly from room temperature to a sintering temperature of 950°–1150° C., thereby producing rare earth element carbides. Accordingly, a liquid phase cannot be produced in a sufficient amount for sintering, failing to provide a sintered body with a sufficient density and so with good magnetic properties. To prevent this phenomenon, it is desirable to carry out a solvent-removing treatment by keeping the green body at a temperature of 50°–500° C., more preferably 50°–250° C. and under pressure of $10^{-1}$ Torr or less, more preferably $5\times10^{-2}$ Torr or less for 30 minutes or more, preferably 60–180 minutes. With this solvent-removing treatment, the solvent remaining in the green body can be fully removed. Incidentally, the solvent-removing temperature may be changed in the range of 50°–500° C.

Also, by carrying out the solvent-removing treatment under pressure of $10^{-1}$ Torr or less at a temperature-elevating speed of 10° C./min or less, preferably 5° C./min or less from room temperature to a temperature up to 500° C., a similar solvent-removing effect can be achieved. Incidentally, the lower limit of the temperature-elevating speed may be 0.5° C./min from the economic point of view.

The present invention will be described in further detail by ways of the following Examples without intention of restricting the scope of the present invention.

EXAMPLE 1

Coarse powder of an Nd-Fe-B-based alloy having a composition by weight of 27.5% of Nd, 2.5% of Pr, 1.0% of Dy, 1.0% of B, 0.2% of Nb, 0.2% of Al and 0.1% of Ga, the balance being substantially Fe, was finely pulverized in an $N_2$ gas atmosphere by a jet mill equipped at its exit with a container filled with a mineral oil (tradename: MC OIL P-02 available from Idemitsu Kosan Co. Ltd.) having a fractional distillation temperature range of 200°–300° C. and a kinetic viscosity at room temperature of 2.0 cSt, and fine Nd-Fe-B-based alloy powder discharged from the jet mill was recovered directly in the mineral oil in an $N_2$ gas atmosphere to provide a starting material mixture 7. A weight ratio of the fine Nd-Fe-B-based alloy powder to the starting material mixture 7 was 70%. The fine Nd-Fe-B-based alloy powder had an average diameter of 4.0 μm.

The starting material mixture 7 was formed into a green body by a molding apparatus shown in FIG. 1 under the conditions that a magnetic field of 8 kOe was applied to a die cavity 4*a*, and that the starting material mixture 7 was charged from a pressure supply means 6 into the die cavity 4*a* equipped with a filter 3 of a 1-mm-thick cloth through an inlet opening 4*b* under high pressure of 10 kgf/cm$^2$. In this case, the filling density of the starting material powder was 2.7 g/cm$^3$. After charging the fine powder into the die cavity 4*a*, a wet-molding was conducted by compressing the powder in the die cavity 4*a* under pressure of 1.0 ton/cm$^2$ while applying the magnetic field to produce a green body.

Next, the green body was subjected to a mineral oil-removing treatment under pressure of $5\times10^{-2}$ Torr while heating it from room temperature to 500° C. at a temperature-elevating speed of 5° C./min, and then sintered by heating it from 500° C. to 1100° C. at a temperature-elevating speed of 30° C./min under the same pressure and keeping it at 1100° C. for 4 hours. The resulting sintered body was heat-treated at 900° C. for 1 hour and then at 600° C. for 1 hour in an Ar gas atmosphere. After machining, the sintered body was measured with respect to the contents of oxygen and carbon, a density and magnetic properties. The results are shown in Table 1.

COMPARATIVE EXAMPLE 1

The same starting material mixture as in Example 1 was formed into a green body by a molding apparatus shown in FIG. 1, by filling a die cavity 4*a* with the starting material mixture, removing an excess mixture by sliding a flat member over a cavity-opened, flat top surface of a die 4, applying an orientated magnetic field of 8 kOe to the die cavity 4*a*, and conducting a wet molding under pressure of 1.0 ton/cm$^2$ while applying the orientated magnetic field. Incidentally, the die 4 used in this Example had no inlet opening 4*b* and was made of the same material as in Example 1. An upper punch means 1 and a filter 3 of this die 4 were the same as in Example 1. The filling density of the starting material powder was 1.5 g/cm$^3$.

The green body was subjected to the same mineral oil-removing treatment, sintering and heat treatment as in Example 1 to produce a sintered body. After machining, the magnetic properties of the sintered body were measured. As a result, it was found that the sintered body had lower residual magnetic flux density and maximum energy product than those of Example 1.

COMPARATIVE EXAMPLE 2

The same starting material mixture as in Example 1 was formed into a green body under the same conditions as in Example 1. The green body was sintered under pressure of $5\times10^{-2}$ Torr while heating it from room temperature to 1100° C. at a temperature-elevating speed of 20° C./min and keeping it at 1100° C. for 4 hours. The resulting sintered body was heat-treated at 900° C. for 1 hour and then at 600° C. for 1 hour in an Ar gas atmosphere. After machining, the sintered body was measured with respect to the contents of oxygen and carbon, a density and magnetic properties. The results are shown in Table 1. As is clear from Table 1, the sintered body of this Example had a higher carbon content, a lower density and poorer residual magnetic flux density, coercive force and maximum energy product than those of Example 1.

COMPARATIVE EXAMPLE 3

Coarse Nd-Fe-B-based alloy powder having the same composition as in Example 1 was finely pulverized in an $N_2$ gas atmosphere by a jet mill equipped at its exit with a container filled with acetone, and finely pulverized Nd-Fe-B-based alloy powder discharged from the jet mill was recovered directly in the acetone to provide a starting material mixture. A weight ratio of the fine alloy powder to the starting material mixture was 70%. The fine alloy powder had an average diameter of 4.1 μm.

This mixture was formed into a green body under the same conditions as in Example 1 to produce a green body in which the filling density of the fine powder was 2.8 g/cm$^3$, and the green body was subjected to the same solvent-removing treatment, sintering and heat treatment as in Example 1 to produce a sintered body. After machining, the magnetic properties of the sintered body were measured. As a result, it was found that the sintered body had lower residual magnetic flux density and maximum energy product than those of Example 1, and that the oxygen content in the sintered body was higher than that of Example 1.

COMPARATIVE EXAMPLE 4

Coarse Nd-Fe-B-based alloy powder having the same composition as in Example 1 was finely pulverized in an $N_2$ gas atmosphere by a jet mill equipped at its exit with a container filled with pure water, and finely pulverized Nd-Fe-B-based alloy powder discharged from the jet mill was recovered directly in the pure water to provide a starting material mixture. A weight ratio of the fine alloy powder to the starting material mixture was 70%. The fine alloy powder had an average diameter of 3.9 μm.

This mixture was formed into a green body under the same conditions as in Example 1 to produce a green body in which the filling density of the fine powder was 2.6 g/cm$^3$, and the green body was subjected to the same solvent-removing treatment, sintering and heat treatment as in Example 1 to produce a sintered body. After machining, the magnetic properties of the sintered body were measured. As a result, it was found as shown in Table 1 that the sintered body had much lower residual magnetic flux density, coercive force and maximum energy product than those of Example 1, and that the oxygen content in the sintered body was higher than that of Example 1.

COMPARATIVE EXAMPLE 5

Coarse Nd-Fe-B-based alloy powder having the same composition as in Example 1 was finely pulverized in an $N_2$ gas atmosphere by a jet mill to provide dry fine powder having an average diameter of 4.0 μm. This dry fine powder was formed into a green body by a molding apparatus shown in FIG. 1, by directly introducing it into a die cavity 4*a*, removing an excess dry powder by sliding a flat member over a cavity-opened, flat top surface of a die 4, applying an orientated magnetic field of 8 kOe to the die cavity 4*a*, and compressing the dry powder under pressure of 1.0 ton/cm$^2$ while applying the orientated magnetic field. Incidentally, the die 4 used in this Example had no inlet opening 4*b* and no filter 3 and was made of the same material as in Example 1. The filling density of the starting material powder was 1.6 g/cm$^3$.

The green body was sintered under pressure of $5\times10^{-2}$ Torr while heating it from room temperature to 1100° C. at a temperature-elevating speed of 20° C./min and keeping it at 1100° C. for 4 hours. The resulting sintered body was heat-treated at 900° C. for 1 hour and then at 600° C. for 1 hour in an Ar gas atmosphere. After machining, the sintered body was measured with respect to magnetic properties. The results are shown in Table 1. As is clear from Table 1, the sintered body of this Example had poorer residual magnetic flux density and maximum energy product than those of Example 1.

COMPARATIVE EXAMPLE 6

Fine powder prepared in Comparative Example 5 having an average diameter of 4.0 μm was formed into a green body in a dry state by a molding apparatus shown in FIG. 1 in which a pressuring means 6 was modified to enable the pressuring of the dry powder with an Ar gas. While applying an orientated magnetic field of 8 kOe to the die cavity 4*a*, the dry powder was introduced into the die cavity 4*a* by means of the pressuring means 6 with an Ar gas of 10 kgf/cm$^2$. However, the dry powder was instantaneously ignited, failing to provide a green body.

EXAMPLE 2

Coarse powder of an Nd-Fe-B-based alloy having a composition by weight of 27.5% of Nd, 2.5% of Pr, 1.0% of Dy, 1.0% of B, 0.2% of Nb, 0.2% of Al and 0.1% of Ca, the balance being substantially Fe, was finely pulverized in an $N_2$ gas atmosphere by a jet mill equipped at its exit with a container filled with a mineral oil (tradename: MC OIL P-02 available from Idemitsu Kosan Co. Ltd.) having a fractional distillation temperature range of 200°–300° C. and a kinetic viscosity at room temperature of 2.0 cSt, and finely pulverized Nd-Fe-B-based alloy powder discharged from the jet mill was recovered directly in the mineral oil in an $N_2$ gas atmosphere to provide a starting material mixture. A weight ratio of the fine Nd-Fe-B-based alloy powder to the starting material mixture was 70%. The fine Nd-Fe-B-based alloy powder had an average diameter of 4.2 μm.

The starting material mixture was formed into a green body by a molding apparatus shown in FIG. 2 under the conditions that a magnetic field of 10 kOe was applied to a die cavity 4*a*, and that the starting material mixture was charged from a pressure supply means into the die cavity 4*a* equipped with a filter 3 made of a porous metal material welded to an upper punch means 1 under high pressure of 10 kgf/cm$^2$. In this case, the filling density of the starting material powder was 2.4 g/cm$^3$. After charging the fine powder into the die cavity 4*a*, a wet-molding was conducted by compressing the powder in the die cavity 4*a* under pressure of 1.0 ton/cm$^2$ while applying the magnetic field to produce a green body.

Next, the green body was subjected to a mineral oil-removing treatment under pressure of $5\times10^{-2}$ Torr while heating it from room temperature to 500° C. at a temperature-elevating speed of 5° C./min, and then sintered by heating it from 500° C. to 1100° C. at a temperature-elevating speed of 30° C./min under the same pressure and keeping it at 1100° C. for 4 hours. The resulting sintered body was heat-treated at 900° C. for 1 hour and then at 600° C. for 1 hour in an Ar gas atmosphere. After machining, the sintered body was measured with respect to the contents of oxygen and carbon, a density and magnetic properties. The results are shown in Table 1.

COMPARATIVE EXAMPLE 7

The starting material mixture prepared in Example 2 was formed into a green body by a molding apparatus shown in FIG. 2, by filling a die cavity 4*a* with the starting material mixture, removing an excess mixture by sliding a flat member over a cavity-opened, flat top surface of a die 4, applying an orientated magnetic field of 10 kOe to the die cavity 4*a*, and conducting a wet molding under pressure of 1.0 ton/cm$^2$ while applying the orientated magnetic field. Incidentally, the die 4 used in this Example had no inlet opening 4*b* and was made of the same material as in Example 2. An upper punch means 1 was the same as in Example 2. The filling density of the starting material powder was 1.4 g/cm$^3$.

The green body was subjected to the same mineral oil-removing treatment, sintering and heat treatment as in Example 2 to produce a sintered body. After machining, the magnetic properties of the sintered body were measured. As a result, it was found that the sintered body had lower residual magnetic flux density and maximum energy product than those of Example 2.

COMPARATIVE EXAMPLE 8

Coarse Nd-Fe-B-based alloy powder having the same composition as in Example 2 was finely pulverized in an $N_2$ gas atmosphere by a jet mill to provide dry fine powder having an average diameter of 3.8 μm. This dry fine powder was formed into a green body by a molding apparatus shown in FIG. 2, by directly introducing it into a die cavity 4*a*, removing an excess dry powder by sliding a flat member over a cavity-opened, flat top surface of a die 4, applying an orientated magnetic field of 10 kOe to the die cavity 4*a*, and compressing the dry powder under pressure of 1.0 ton/cm$^2$ while applying the orientated magnetic field. Incidentally, the die 4 used in this Example had no inlet opening 4*b* and was made of the same material as in Example 2, and the upper punch means 1 had no solvent-discharging opening and no filter 3 made of a porous metal material and was made of the same material as in Example 2. The filling density of the starting material powder was 1.5 g/cm$^3$.

The green body was sintered under pressure of $5\times10^{-2}$ Torr while heating it from room temperature to 1100° C. at a temperature-elevating speed of 30° C./min and keeping it at 1100° C. for 4 hours. The resulting sintered body was heat-treated at 900° C. for 1 hour and then at 600° C. for 1 hour in an Ar gas atmosphere. After machining, the sintered body was measured with respect to magnetic properties. The results are shown in Table 1. As is clear from Table 1, the sintered body of this Example had poorer residual magnetic flux density and maximum energy product than those of Example 2.

TABLE 1

| No. | Density (g/cm$^3$) | Oxygen (ppm) | Carbon (wt. %) | Br(1) (kG) | iHc(2) (kOe) | $BH_{max}$(3) (MGOe) |
|---|---|---|---|---|---|---|
| Example | | | | | | |
| 1 | 7.55 | 2000 | 0.05 | 13.3 | 14.0 | 42.5 |
| 2 | 7.56 | 2100 | 0.05 | 13.4 | 13.8 | 43.1 |
| Comparative Example | | | | | | |
| 1 | 7.55 | 2000 | 0.05 | 12.1 | 14.1 | 34.1 |
| 2 | 7.42 | 3200 | 0.10 | 12.8 | 12.5 | 38.2 |
| 3 | 7.53 | 2700 | 0.05 | 12.6 | 13.8 | 37.0 |
| 4 | 7.39 | 7200 | 0.05 | 11.5 | 7.8 | 25.5 |
| 5 | 7.54 | 5500 | 0.05 | 12.1 | 14.0 | 34.0 |
| 6(4) | — | — | — | — | — | — |
| 7 | 7.55 | 2000 | 0.05 | 13.1 | 13.7 | 40.5 |
| 8 | 7.55 | 5700 | 0.05 | 13.0 | 13.0 | 40.1 |

Note:
(1)Residual magnetic flux density.
(2)Coercive force.
(3)Maximum energy product.
(4)Properties were not measured because the dry powder was burned.

EXAMPLE 3

Coarse powder of an Nd-Fe-B-based alloy having a composition by weight of 29.0% of Nd, 0.5% of Pr, 2.0% of Dy, 1.0% of B, 0.3% of Nb and 0.2% of Al, the balance being substantially Fe, was finely pulverized in an $N_2$ gas atmosphere by a jet mill equipped at its exit with a container filled with a synthetic oil (tradename: DN. ROLL OIL AL-35 available from Idemitsu Kosan Co. Ltd.) having a fractional distillation temperature range of 200°–300° C. and a kinetic viscosity at room temperature of 2.1 cSt, and finely pulverized Nd-Fe-B-based alloy powder discharged from the jet mill was recovered directly in the synthetic oil in an $N_2$ gas atmosphere to provide a starting material mixture. A weight ratio of the fine Nd-Fe-B-based alloy powder to the starting material mixture was 65%. The fine Nd-Fe-B-based alloy powder had an average diameter of 4.5 μm.

The starting material mixture was formed into a green body by a molding apparatus shown in FIG. 3 under the conditions that a magnetic field of 4 kOe was applied to a die cavity 4*a*, and that the starting material mixture was charged from a pressure supply means into the die cavity 4*a* equipped with a filter 3 made of a porous metal material and welded to the upper punch means 1 under high pressure of 3 kgf/cm$^2$. In this case, the filling density of the starting material powder was 2.2 g/cm$^3$. After charging the fine powder into the die cavity 4*a*, a wet-molding was conducted by compressing the powder in the die cavity 4*a* under pressure of 0.8 ton/cm$^2$ while applying the magnetic field to produce a green body.

Next, the green body was subjected to a mineral oil-removing treatment under pressure of $3\times10^{-2}$ Torr while heating it from room temperature to 500° C. at a temperature-elevating speed of 7° C./min, and then sintered by heating it from 500° C. to 1080° C. at a temperature-elevating speed of 30° C./min under the same pressure and keeping it at 1080° C. for 4 hours. The resulting sintered body was heat-treated at 900° C. for 1 hour and then at 600° C. for 1 hour in an Ar gas atmosphere. After machining, the sintered body was measured with respect to the contents of oxygen and carbon, a density and surface magnetic flux density (peak value). The results are shown in Table 2.

COMPARATIVE EXAMPLE 9

The starting material mixture prepared in Example 3 was formed into a green body by a molding apparatus shown in FIG. 3, by filling a die cavity 4*a* with the starting material mixture, removing an excess mixture by sliding a flat member over a cavity-opened, flat top surface of a die 4, applying an orientated magnetic field of 4 kOe to the die cavity 4*a*, and conducting a wet molding under pressure of 0.8 ton/cm$^2$ while applying the orientated magnetic field. Incidentally, the die 4 used in this Example had no inlet opening 4*b* and was made of the same material as in Example 3. An upper punch means 1 of this die 4 was the same as in Example 3. The filling density of the starting material powder was 1.5 g/cm$^3$.

The green body was subjected to the same mineral oil-removing treatment, sintering and heat treatment as in Example 3 to produce a sintered body. After machining, the surface magnetic flux density (peak value) of the sintered body were measured. The results are shown in Table 2. As is clear from Table 2, the sintered body had a lower surface magnetic flux density than that of Example 3.

COMPARATIVE EXAMPLE 10

Coarse Nd-Fe-B-based alloy powder having the same composition as in Example 3 was finely pulverized in an $N_2$ gas atmosphere by a jet mill to provide dry fine powder having an average diameter of 4.3 μm. This dry fine powder was formed into a green body by a molding apparatus shown in FIG. 3, by directly introducing it into a die cavity 4*a*, removing an excess dry powder by sliding a flat member over a cavity-opened, flat top surface of a die 4, applying an orientated magnetic field of 4 kOe to the die cavity 4*a*, and compressing the dry powder under pressure of 0.8 ton/cm$^2$ while applying the orientated magnetic field. Incidentally, the die 4 used in this Example had no inlet opening 4*b* and was made of the same material as in Example 3, and the upper punch means 1 used in this Example had no filter 3 of a porous metal material and was made of the same material as in Example 3. The filling density of the starting material powder was 1.6 g/cm$^3$.

The green body was sintered under pressure of $3\times10^{-2}$ Torr while heating it from room temperature to 1080° C. at a temperature-elevating speed of 30° C./min and keeping it at 1080° C. for 4 hours. The resulting sintered body was heat-treated at 900° C. for 1 hour and then at 600° C. for 1 hour in an Ar gas atmosphere. After machining, the sintered body was measured with respect to surface magnetic flux density (peak value). The results are shown in Table 2. As is clear from Table 2, the sintered body of this Example had a poorer surface magnetic flux density than that of Example 3.

TABLE 2

| No. | Density (g/cm$^3$) | Oxygen (ppm) | Carbon (wt. %) | Surface Magnetic Flux Density (kG) |
|---|---|---|---|---|
| Example | | | | |
| 3 | 7.54 | 1800 | 0.04 | 5.5 |
| Comparative Example | | | | |
| 9 | 7.55 | 1800 | 0.04 | 4.8 |
| 10 | 7.53 | 5500 | 0.04 | 4.6 |

EXAMPLE 4

Coarse powder of an Nd-Fe-B-based alloy having a composition by weight of 28.0% of Nd, 2.5% of Pr, 1.0% of Dy, 1.0% of B, 4.0% of Co, 0.2% of Nb and 0.2% of Al, the balance being substantially Fe, was finely pulverized in an $N_2$ gas atmosphere by a jet mill equipped at its exit with a container filled with a mineral oil (tradename: MC OIL P-05 available from Idemitsu Kosan Co. Ltd.) having a fractional distillation temperature range of 250°–350° C. and a kinetic viscosity at room temperature of 5.0 cSt, and finely pulverized Nd-Fe-B-based alloy powder discharged from the jet mill was recovered directly in the mineral oil in an $N_2$ gas atmosphere to provide a starting material mixture. A weight ratio of the fine Nd-Fe-B-based alloy powder to the starting material mixture was 70%. The fine Nd-Fe-B-based alloy powder had an average diameter of 3.9 μm.

The starting material mixture was formed into a green body by a molding apparatus shown in FIGS. 4 and 5 under the conditions that a magnetic field of 7 kOe was applied to a die cavity 4*a*, and that the starting material mixture was charged from a pressure supply means into the die cavity 4*a* equipped with a filter 3 made of a porous metal material and welded to the upper punch means 1 under high pressure of 15 kgf/cm$^2$. In this case, the filling density of the starting material powder was 2.5 g/cm$^3$. After charging the fine powder into the die cavity 4*a*, a wet-molding was conducted by compressing the powder in the die cavity 4*a* under pressure of 1.0 ton/cm$^2$ while applying the magnetic field to produce a green body.

Next, the green body was subjected to a mineral oil-removing treatment under pressure of $5\times10^{-2}$ Torr while heating it from room temperature to 500° C. at a temperature-elevating speed of 5° C./min, and then sintered by heating it from 500° C. to 1070° C. at a temperature-elevating speed of 30° C./min under the same pressure and keeping it at 1070° C. for 4 hours. The resulting sintered body was heat-treated at 900° C. for 1 hour and then at 600° C. for 1 hour in an Ar gas atmosphere. After machining, the sintered body was measured with respect to the contents of oxygen and carbon, a density and surface magnetic flux density (peak value). The results are shown in Table 3.

COMPARATIVE EXAMPLE 11

The starting material mixture prepared in Example 4 was formed into a green body by a molding apparatus shown in FIGS. 4 and 5, by filling a die cavity 4*a* with the starting material mixture, removing an excess mixture by sliding a flat member over a cavity-opened, flat top surface of a die 4, applying an orientated magnetic field of 7 kOe to the die cavity 4*a*, and conducting a wet molding under pressure of 1.0 ton/cm$^2$ while applying the orientated magnetic field. Incidentally, the die 4 used in this Example had no inlet opening 4*b* and was made of the same material as in Example 4. An upper punch means 1 of this die 4 was the same as in Example 4. The filling density of the starting material powder was 1.5 g/cm$^3$.

The green body was subjected to the same mineral oil-removing treatment, sintering and heat treatment as in Example 4 to produce a sintered body. After machining, the surface magnetic flux density (peak value) of the sintered body was measured. The results are shown in Table 3. As is clear from Table 3, the sintered body had a lower surface magnetic flux density than that of Example 4.

COMPARATIVE EXAMPLE 12

Coarse Nd-Fe-B-based alloy powder having the same composition as in Example 4 was finely pulverized in an $N_2$ gas atmosphere by a jet mill to provide dry fine powder having an average diameter of 4.0 μm. This dry fine powder was formed into a green body by a molding apparatus shown in FIGS. 4 and 5, by directly introducing it into a die cavity 4*a*, removing an excess dry powder by sliding a flat member over a cavity-opened, flat top surface of a die 4, applying an orientated magnetic field of 7 kOe to the die cavity 4*a*, and compressing the dry powder under pressure of 1.0 ton/cm$^2$ while applying the orientated magnetic field. Incidentally, the die 4 used in this Example had no inlet opening 4*b* and was made of the same material as in Example 4, and the upper punch means 1 used in this Example had a filter 3 made of a porous metal material and was made of the same material as in Example 4. The filling density of the starting material powder was 1.5 g/cm$^3$.

The green body was sintered under pressure of $5\times10^{-2}$ Torr while heating it from room temperature to 1070° C. at a temperature-elevating speed of 30° C./min and keeping it at 1070° C. for 4 hours. The resulting sintered body was heat-treated at 900° C. for 1 hour and then at 600° C. for 1 hour in an Ar gas atmosphere. After machining, the sintered body was measured with respect to a surface magnetic flux density. The results are shown in Table 3. As is clear from Table 3, the sintered body of this Example had a poorer surface magnetic flux density than that of Example 4.

TABLE 3

| No. | Density (g/cm$^3$) | Oxygen (ppm) | Carbon (wt. %) | Surface Magnetic Flux Density (kG) |
|---|---|---|---|---|
| Example | | | | |
| 4 | 7.55 | 1900 | 0.05 | 7.0 |

TABLE 3-continued

| No. | Density ($g/cm^3$) | Oxygen (ppm) | Carbon (wt. %) | Surface Magnetic Flux Density (kG) |
|---|---|---|---|---|
| Comparative Example | | | | |
| 11 | 7.54 | 1800 | 0.05 | 6.2 |
| 12 | 7.53 | 5400 | 0.05 | 6.0 |

As described above in detail, in the method of the present invention the fine R-Fe-B-based magnet powder is highly orientated in the mixture being compressed in a die cavity 4a so that the resultant R-Fe-B-based, sintered magnet is provided with high magnetic properties.

What is claimed is:

1. A method for producing an R-Fe-B-based, sintered magnet, wherein R is one or more of rare earth elements including Y, comprising the steps of:

mixing fine R-Fe-B-based magnet powder with a mineral oil and/or a synthetic oil to prepare a mixture, wherein the mineral oil and the synthetic oil, used alone or in combination, have a fractional distillation temperature range of 150°–400° C. and a kinetic viscosity of 10 cSt or less at room temperature;

charging said mixture into a die cavity under pressure so as to have a filling density of 1.8 $g/cm^3$ or more;

subjecting said mixture to a wet molding to prepare a green body; and then sintering said green body.

2. A method for producing an R-Fe-B-based, sintered magnet, wherein R is one or more of rare earth elements including Y, comprising the steps of:

mixing fine R-Fe-B-based magnet powder with a mineral oil and/or a synthetic oil to prepare a mixture, wherein the mineral oil and the synthetic oil, used alone or in combination, have a fractional distillation temperature range of 150°–400° C. and a kinetic viscosity of 10 cSt or less at room temperature;

charging said mixture into a die cavity under pressure so as to have a filling density of 1.8 $g/cm^3$ or more while applying an oriented magnetic field to said die cavity;

subjecting said mixture to a wet molding while orienting said powder to prepare a green body; and then sintering said green body.

3. A method for producing an R-Fe-B-based, sintered magnet, wherein R is one or more of rare earth elements including Y, comprising the steps of:

finely pulverizing an R-Fe-B-based magnet material in an inert gas atmosphere to prepare fine R-Fe-B-based magnet powder in a dry state;

introducing said fine R-Fe-B-based magnet powder into a mineral oil and/or a synthetic oil in an inert gas atmosphere to prepare a mixture, wherein the mineral oil and the synthetic oil, used alone or in combination, have a fractional distillation temperature range of 150°–400° C. and a kinetic viscosity of 10 cSt or less at room temperature;

charging said mixture into a die cavity under pressure so as to have a filling density of 1.8 $g/cm^3$ or more while applying an oriented magnetic field to said die cavity;

subjecting said mixture to a wet molding while orienting said powder to prepare a green body; and then sintering said green body.

4. The method for producing an R-Fe-B-based, sintered magnet according to claim 1, wherein said mixture is charged into said die cavity under pressure of 1 $kgf/cm^2$ or more.

5. The method for producing an R-Fe-B-based, sintered magnet according to claim 2, wherein said mixture is charged into said die cavity to which an orientated magnetic field of 2 kOe or more is applied, and said mixture is subjected to a wet molding while orientating said powder in said die cavity.

6. The method for producing an R-Fe-B-based, sintered magnet according to claim 1, wherein the amount of said fine R-Fe-B-based magnet powder is 50–80 weight % based on the mixture of said fine R-Fe-B-based magnet powder with said mineral oil or said synthetic oil.

7. The method for producing an R-Fe-B-based, sintered magnet according to claim 2, wherein the amount of said fine R-Fe-B-based magnet powder is 50–80 weight % based on the mixture of said fine R-Fe-B-based magnet powder with said mineral oil or said synthetic oil.

8. The method for producing an R-Fe-B-based, sintered magnet according to claim 3, wherein the amount of said fine R-Fe-B-based magnet powder is 50–80 weight % based on the mixture of said fine R-Fe-B-based magnet powder with said mineral oil or said synthetic oil.

9. The method for producing an R-Fe-B-based, sintered magnet according to claim 1, wherein the green body is kept wet with a mineral oil, a synthetic oil or a hydrophobic organic solvent until said green body is sintered.

10. The method for producing an R-Fe-B-based, sintered magnet according to claim 2, wherein the green body is kept wet with a mineral oil, a synthetic oil or a hydrophobic organic solvent until said green body is sintered.

11. The method for producing an R-Fe-B-based, sintered magnet according to claim 3, wherein the green body is kept wet with a mineral oil, a synthetic oil or a hydrophobic organic solvent until said green body is sintered.

12. The method for producing an R-Fe-B-based, sintered magnet according to claim 1, wherein the green body is kept at a temperature of 50°–500° C. under pressure of $10^{-1}$ Torr or less for 30 minutes or more to remove said mineral oil or said synthetic oil, and then sintered.

13. The method for producing an R-Fe-B-based, sintered magnet according to claim 2, wherein the green body is kept at a temperature of 50°–500° C. under pressure of $10^{-1}$ Torr or less for 30 minutes or more to remove said mineral oil or said synthetic oil, and then sintered.

14. The method for producing an R-Fe-B-based, sintered magnet according to claim-3, wherein the green body is kept at a temperature of 50°–500° C. under pressure of $10^{-1}$ Torr or less for 30 minutes or more to remove said mineral oil or said synthetic oil, and then sintered.

15. The method for producing an R-Fe-B-based, sintered magnet according to claim 1, wherein the green body is heated from room temperature to a temperature up to 500° C. at a temperature-elevating speed of 10° C./min or less under pressure of $10^{-1}$ Torr or less to remove said mineral oil or said synthetic oil, and then sintered.

16. The method for producing an R-Fe-B-based, sintered magnet according to claim 2, wherein the green body is heated from room temperature to a temperature up to 500° C. at a temperature-elevating speed of 10° C./min or less under pressure of $10^{-1}$ Torr or less to remove said mineral oil or said synthetic oil, and then sintered.

17. The method for producing an R-Fe-B-based, sintered magnet according to claim 3, wherein the green body is heated from room temperature to a temperature up to 500°

C. at a temperature-elevating speed of 10° C./min or less under pressure of $10^{-1}$ Torr or less to remove said mineral oil or said synthetic oil, and then sintered.

18. A method for producing an R-Fe-B-based, sintered magnet, wherein R is one or more of rare earth elements including Y, comprising the steps of mixing fine R-Fe-B-based magnet powder with a mineral oil and/or a synthetic oil having a fractional distillation temperature range of 150°–400° C. and a kinetic viscosity of 10 cSt or less to prepare a mixture; charging said mixture under pressure so as to have a filling density of 1.8 g/cm$^3$ or more into a die cavity equipped with a filter while removing said mineral oil and/or said synthetic oil from said mixture; compressing said mixture in said die cavity to carry out a wet molding for preparing a green body; heating said green body to a temperature up to 500° C. at a temperature-elevating speed of 10° C./min or less under pressure of $10^{-1}$ Torr or less for 30 minutes or more to remove said mineral oil and/or said synthetic oil from said green body; and then sintering said green body.

19. A method for producing an R-Fe-B-based, sintered magnet, wherein R is one or more of rare earth elements including Y, comprising the steps of mixing fine R-Fe-B-based magnet powder with a mineral oil and/or a synthetic oil having a fractional distillation temperature range of 150°–400° C. and a kinetic viscosity of 10 cSt or less to prepare a mixture; charging said mixture under pressure so as to have a filling density of 1.8 g/cm$^3$ or more into a die cavity equipped with a filter, to which an orientated magnetic field is applied, while removing said mineral oil and/or said synthetic oil from said mixture; compressing said mixture in said die cavity to carry out a wet molding while orientating said powder to prepare a green body; heating said green body to a temperature up to 500° C. at a temperature-elevating speed of 10° C./min or less under pressure of $10^{-1}$ Torr or less for 30 minutes or more to remove said mineral oil and/or said synthetic oil from said green body; and then sintering said green body.

20. A method for producing as R-Fe-B-based, sintered magnet, wherein R is one or more of rare earth elements including Y, comprising the steps of finely pulverizing an R-Fe-B-based magnet material in an inert gas atmosphere to prepare fine R-Fe-B-based magnet powder in a dry state; introducing said fine R-Fe-B-based magnet powder in an inert gas atmosphere into a mineral oil and/or a synthetic oil having a fractional distillation temperature range of 150°–400° C. and a kinetic viscosity of 10 cSt or less; mixing said fine R-Fe-B-based magnet powder with said mineral oil and/or said synthetic oil to prepare a mixture; charging said mixture under pressure so as to have a filling density of 1.8 g/cm$^3$ or more into a die cavity equipped with a filter, to which an orientated magnetic field is applied, while removing said mineral oil and/or said synthetic oil from said mixture; compressing said mixture in said die cavity to carry out a wet molding while orientating said powder to prepare a green body; heating said green body to a temperature up to 500° C. at a temperature-elevating speed of 10° C./min or less under pressure of $10^{-1}$ Torr or less for 30 minutes or more to remove said mineral oil and/or said synthetic oil from said green body; and then sintering said green body.

* * * * *